US005205801A

United States Patent [19]

Haner

[11] Patent Number: 5,205,801

[45] Date of Patent: Apr. 27, 1993

[54] EXERCISE SYSTEM

[75] Inventor: Lambert Haner, Rocky River, Ohio

[73] Assignee: The Scott Fetzer Company, Westlake, Ohio

[21] Appl. No.: 502,069

[22] Filed: Mar. 29, 1990

[51] Int. Cl.[5] ..... A63B 21/00

[52] U.S. Cl. ..... 482/63; 482/64

[58] Field of Search ..... 128/25 R; 272/73, 93, 272/96, 129, DIG. 5, DIG. 6

[56] References Cited

U.S. PATENT DOCUMENTS

| | | | |
|---|---|---|---|
| 2,218,859 | 10/1940 | Schweitzer, Jr. . | |
| 2,784,591 | 3/1957 | Shoor . | |
| 3,057,201 | 10/1962 | Jaeger . | |
| 3,395,698 | 8/1968 | Morehouse . | |
| 3,442,131 | 5/1969 | Leyten . | |
| 3,505,992 | 4/1970 | Jaeger . | |
| 3,705,721 | 12/1972 | Lulay et al. . | |
| 3,765,245 | 10/1973 | Hampl . | |
| 3,869,121 | 3/1975 | Flavell . | |
| 3,902,480 | 9/1975 | Wilson | 272/129 X |
| 3,964,742 | 6/1976 | Carnielli | 272/73 |
| 3,995,491 | 12/1976 | Wolfla, II . | |
| 4,060,239 | 11/1977 | Pfleiderer et al. . | |
| 4,084,810 | 4/1978 | Forsman . | |
| 4,358,105 | 11/1982 | Sweeney | 482/64 X |
| 4,602,373 | 7/1986 | Dorfman . | |
| 4,678,182 | 7/1987 | Nakao et al. . | |
| 4,691,694 | 9/1987 | Boyd et al. | 272/129 X |
| 4,713,567 | 12/1987 | Fey et al. | 482/63 X |
| 4,775,145 | 10/1988 | Tsuyama | 482/63 X |
| 4,822,037 | 4/1989 | Makansi et al. | 272/129 |

FOREIGN PATENT DOCUMENTS

| | | |
|---|---|---|
| 0028209 | 5/1981 | European Pat. Off. . |
| 0199442 | 10/1986 | European Pat. Off. . |
| 2054214 | 11/1970 | Fed. Rep. of Germany . |
| 2349212 | 10/1973 | Fed. Rep. of Germany . |
| 2540492 | 3/1977 | Fed. Rep. of Germany . |
| 139390 | 1/1980 | Fed. Rep. of Germany . |
| 2844125 | 5/1980 | Fed. Rep. of Germany . |
| 2852702 | 6/1980 | Fed. Rep. of Germany . |
| 2281774 | 9/1974 | France . |
| 997656 | 2/1983 | U.S.S.R. . |

OTHER PUBLICATIONS

Bosch brochure of the Bosch CW System.

*Primary Examiner*—Richard J. Apley
*Assistant Examiner*—Glenn E. Richman
*Attorney, Agent, or Firm*—Watts, Hoffmann, Fisher & Heinke

[57] ABSTRACT

An exercise system including an exercise device having a user actuatable pedal mechanism coupled to a permanent magnet, DC motor operated as a generator and a load control arrangement for controlling a braking effect exerted by the DC motor on the pedal mechanism. The output of the DC motor is connected to a power dissipation circuit including plurality of power MOSFETs. The system can be operated in a constant power or a constant force mode. In the constant power mode, the load control monitors the output of the DC generator and compares it with a selected power level and in response to detected errors between the signals, adjusts the conductivity of the power MOSFETs to maintain the power output independent of actuation speed. Current flow through the power MOSFETs is monitored and the relative conductivity between the MOSFETs is adjusted in order to maintain substantially equal current flows through each MOSFET. Power for the electronics is obtained from the DC generator using a two-stage power regulation circuit in which the second stage includes positive and negative regulators and the first stage includes a means for limiting the input voltage to the regulators to a predetermined maximum.

33 Claims, 5 Drawing Sheets

Fig.4

EXERCISE SYSTEM

TECHNICAL FIELD

The present invention relates generally to exercise machines and in particular to an exercise system in which a DC generator is used as an adjustable load source and is mechanically driven by the user during an exercise session.

BACKGROUND ART

There are many forms of exercise devices on the market today and a variety of exercise devices are the subjects of prior patents. One common type of exercise device is an exercise bicycle sometimes called a "bicycle ergometer". In this type of device, the user expends energy by pedaling against a resistance or braking element forming part of the bicycle. For example, in a mechanical exercise bicycle, the resistance to pedaling experienced by the user is provided by a friction brake which normally includes friction pads that act against a rotating disk. The clamping pressure of the friction pads is usually adjustable to vary the load against which the user pedals.

In other type of exercise bicycles, the load is electrically generated. For example, some currently available exercise bicycles utilize an "eddy-current brake". In this type of bicycle, a disk, mechanically coupled to a pedaling mechanism, is rotated at high speed. Radial surfaces of the disk pass between an electromagnet pole assembly which when energized applies a braking force against the disk. The braking force or load felt by the user is adjustable and is a function of the energization level of the electromagnetic assembly. With this type of loading device, an outside source of power must be connected to the bicycle in order to energize the electromagnetic poles of the eddy-current brake. In addition, the "eddy-current" phenomena relies on the precise positioning of the disk with respect to the magnet pole assembly. As a result, it is believed that the eddy-current brake is relatively costly to manufacture and maintain. Another disadvantage of this type of exercise device is that a direct measurement of the load or work output of the eddy-current brake is not possible. If information regarding load or even operating speed is desired, a separate load or speed sensor must be used. An example of an exercise bicycle that utilizes an eddy-current brake is described in U.S. Pat. No. 4,678,182.

Exercise bicycles utilizing AC or DC generators as load devices have also been suggested. For example, U.S. Pat. No. 3,765,245 illustrates an ergometer which includes a patient driven, three phase AC generator as the loading device. The energy generated upon rotation of the armature by the patient via a pedaling mechanism, is dissipated across a controllable variable resistance load which comprises a load resistor and a power transistor connected in a series.

U.S. Patent No. 3,057,201 illustrates an example of an exercise bicycle that uses a DC generator as a load device. In the disclosed ergometer, a control circuit regulates the excitation of the field winding of the DC generator in order to control its power output independent of the operating speed of the ergometer. With the disclosed arrangement, an outside source of power is needed. The control circuit controls the application of the external power to the field windings of the generator in order to change the field excitation and hence, the load exerted on the user.

Commercially available exercise bicycles, designed for general fitness applications, often provide a workload that is a function of pedaling speed. When these bicycles are used for cardiac rehabilitation, the patient is instructed to pedal at a prescribed speed and maintain that speed constant during the exercise time. It has been found that due to either lack of concentration, perceived discomfort or distractions, the patient will usually pedal at speeds other than prescribed and thus the workload exerted by the patent will vary accordingly.

In general fitness applications, this does not normally pose a problem. However, in cardiac rehabilitation, it is important that the recovering patient operate the exercise device at a constant workload. For this reason, exercise bicycles in which the workload varies with pedaling speed, are not considered acceptable for cardiac rehabilitation applications.

For cardiac rehabilitation applications, it is also important that the exercise device maintain a relatively constant calibration from one exercise session to another so that performance changes by a given patient can be closely monitored over the entire rehabilitation process. In other words, it is important that the physician be able to set the same power level on the bicycle for each session it is used by a given patient.

DISCLOSURE OF THE INVENTION

The present invention provides a new and improved exercise system including an exercise device which utilizes a DC generator, as an adjustable load source. Control circuitry is provided for enabling the exercise device to be operated in either a constant work (constant power) mode or a constant force mode.

In accordance with the invention, the exercise device includes a user operated actuating mechanism that is operatively connected to a DC generator such that actuation of the mechanism by the user produces rotation in a drive shaft of the DC generator. A power dissipation circuit is connected to the output of the generator and is controlled in order to adjust a braking effect exerted by the DC generator on the actuating mechanism. As a result the user or patient is required to expend energy or produce work in order to operate the exercise device, the level of work being a function of the braking force exerted by the generator. The exercise system includes a compensation circuit that forms part of the control circuit and is operative to compensate for electrical losses in the generator due to internal electrical resistance, etc.

According to one feature of the invention, the output of the DC generator is dissipated across one or more semi-conductor devices whose conductivity is adjusted by the control circuit. In accordance with this feature, the control circuit monitors the output of the generator, compares it with a desired output and generates a control signal to alter the conductivity of the semi-conductor device if an error exists. In the preferred embodiment of this feature of the invention, the semi-conductor device comprises a power MOSFET. Preferably, a plurality of MOSFETs are employed and the output of the DC generator is distributed substantially equally among the semi-conductors. A balancing circuit including a current sensor monitors the current output of each MOSFET and adjusts the conductivity of each MOSFET in order to balance the current flow. In the preferred and illustrated embodiment, the current sensor includes a resistor having a relatively small ohmic value i.e. less than one ohm, that is connected in series with the drain of each MOSFET.

It has been found that MOSFET type semi-conductors do not normally suffer from secondary breakdown phenomena that is common in junction type bi-polar transistors. As a result, power MOSFETs can be operated at much higher voltages without reducing their current carrying capacity (as is the case with most bi-polar transistors).

According to another feature of the invention, the power output of the generator is determined by a circuit that produces a signal that is proportional to the product of the generator output current and the output voltage; the disclosed circuit eliminates the need for an expensive "multiplier" chip. The circuit includes a frequency to voltage converter which is operative to convert a voltage signal to a signal comprising a series of pulses in which the frequency of the pulses is a function of either the output current or the voltage output of the DC generator. In the disclosed embodiment, a voltage signal proportional to current is input to the voltage to frequency converter and is preferably obtained using a current sense resistor disposed in series with one output of the generator. In the illustrated embodiment, a signal proportional to the voltage output of the generator is used to modulate the frequency signal so that the instantaneous amplitude of the pulses is proportional to the voltage output of the generator. By integrating this modulated frequency signal (in which the frequency of the pulses represents the current output of the generator and the amplitude of the pulses represents the voltage output of the generator), a signal proportional to the product of current and voltage is obtained and hence the integrated signal represents the electrical power output of the generator.

According to another feature in the invention, a control circuit compensates for the mechanical power being dissipated in the exercise device due to friction losses, etc. According to this feature, a signal proportional to the speed of the generator is added to the electrical power signal to produce a signal that represents the total power output including mechanical and electrical load, of the exercise device.

With the disclosed apparatus an exercise device is provided in which the work output of the user can be maintained constant independent of operating speed or alternately, can be operated in a mode in which the force exerted by the user on the actuating mechanism remains constant independent of actuating speed. In this latter mode of operation, as the actuation speed increases, the power output of the user increases proportionately. When operated in a constant power mode, the energy expended by the user can be carefully controlled without resort to indicators or the like for advising the user that the actuating speed at which the device is being operated is not correct for the power level selected. With the disclosed device, the user can actuate the mechanism at a comfortable speed and the control system will automatically adjust the braking force in order to maintain a constant power output.

According to the preferred and illustrated embodiment, the exercise device comprises an exercise bicycle or bicycle ergometer that includes a pedal mechanism mechanically coupled to the DC generator so that rotation of the pedal mechanism by the user produces attendant rotation in the generator. When the device is used in a constant power mode, the power output of the generator remains constant independent of generator speed. Thus, as the patient increases pedaling speed, the electrically generated braking force is reduced proportionately. When used in a constant force mode, the force that must be applied to the pedaling mechanism by the user remains constant independent of the rotational speed of the pedal mechanism.

In the disclosed embodiment, the DC generator is a permanent magnet, DC motor operated as a generator. It has been found that inexpensive permanent magnet DC motors are readily available and thus the disclosed exercise device can be manufactured at a reasonable cost. In addition, the DC motor can be externally powered in order to drive the exercise device which may be useful for calibrating purposes, i.e., to determine the mechanical load the exercise device places on the user. In addition, the DC motor may be energized in order to drive the actuating mechanism for a user who is using the device to simply provide movement to a limb or limbs and does not require (or does not want) energy to be expended in operating the device.

According to still another feature of the invention, a fly wheel is mounted to the output shaft of the DC motor. Because a pedaling mechanism is used, the force needed to rotate the pedals by the user is dependent on the pedal position. In theory, when the pedals are vertical the user must press with almost infinite force in order to achieve rotation whereas at the horizontal position, a relatively small amount of force is necessary to produce movement. To overcome this problem, the system uses the stored kinetic energy of the fly wheel attached to the motor shaft. It has been found, that with a pedal mechanism having a 50:1 ratio between the pedal sprocket and the motor shaft, a fly wheel comprised of a steel disk 5" in diameter and ¼" thick and weighing three pounds provides a sufficient moment of inertia so that the force needed to rotate the mechanism at 40 r.p.m. (which is considered a comfortable pedaling speed) is not excessive. As is well recognized, the weight of the fly wheel can be reduced by increasing its diameter while decreasing its thickness.

According to still another feature of the invention, a portion of the generator output is used to provide power to the control circuit. Since the generator voltage can vary substantially and has been found to vary between 10 and 80 volts for some DC motors, a circuit is provided that clamps the generator output, applied to the DC power supply to a predetermined maximum value, i.e. 30 volts. By preprocessing this input to the power supply, relatively inexpensive, off the shelf voltage regulators can be used to provide the positive and minus voltages required In the disclosed embodiment, the negative voltage is provided by a charge pump which utilizes a ring counter for activating a pair of transistors that charges and discharges a capacitor to provide the necessary negative voltage input to a negative voltage regulator.

Additional features of the invention will become apparent and a fully understanding obtained by reading the following detailed description made in connection with the accompanying drawings.

BEST MODE FOR CARRYING OUT THE INVENTION

Figure 1:
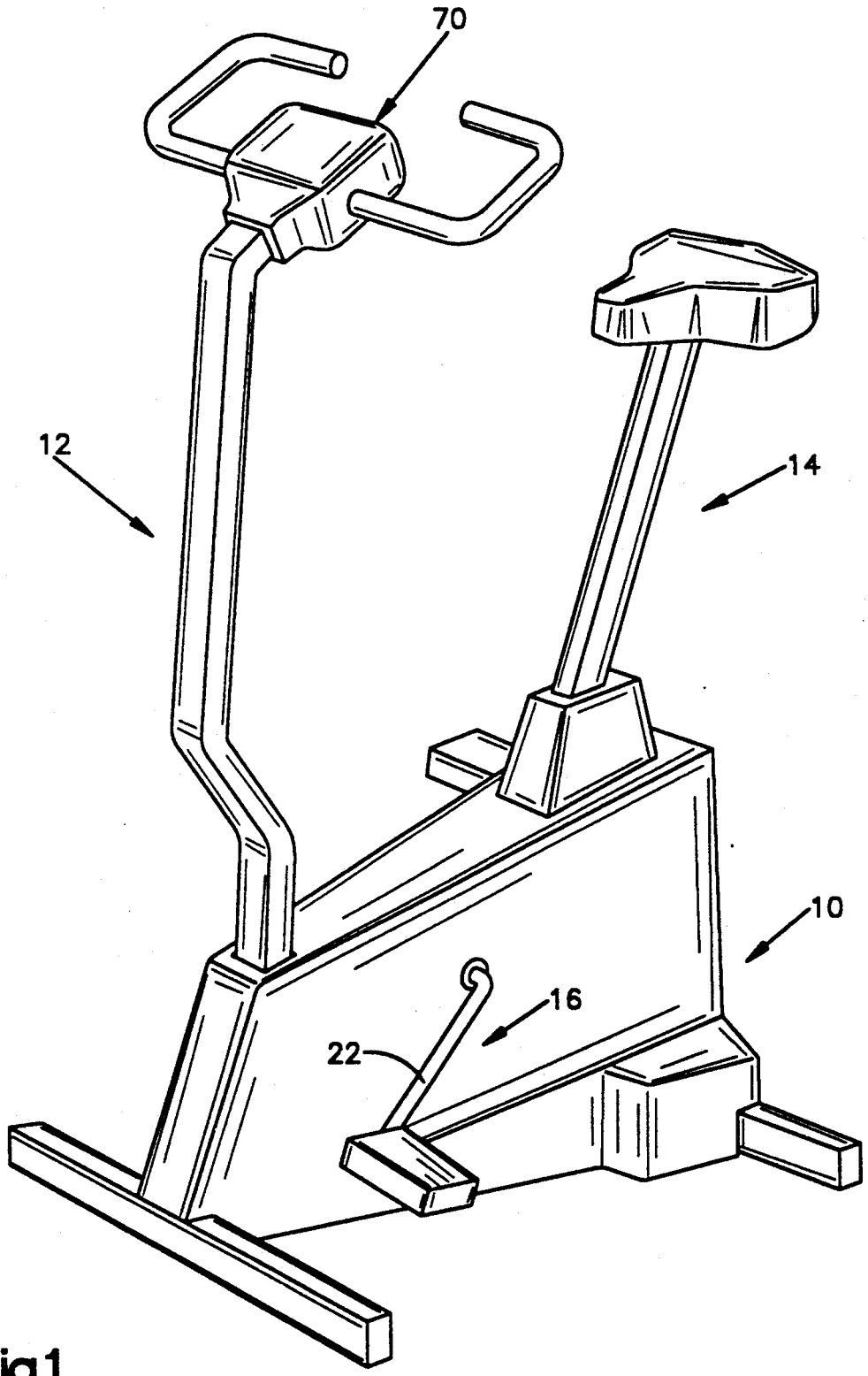
FIG. 1 is a perspective view of an exercise bicycle embodying the present invention.

FIG. 1 illustrates the overall construction of an exercise bicycle or "bicycle ergometer" constructed in accordance with the preferred embodiment of the invention. The present invention relates to a method and apparatus for providing a load against which a user expends energy in operating an exercise device and a control arrangement for controlling that load. The loading device and method for controlling the loading device is adaptable to a wide variety of exercise devices and this invention should not be limited to a bicycle ergometer.

Figure 2:
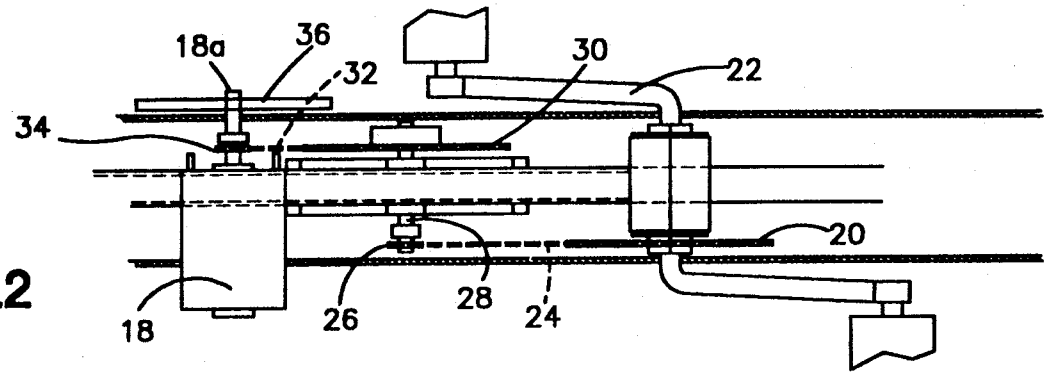
FIG. 2 is a fragmentary, side view of the exercise bicycle, shown somewhat schematically and with external covers removed in order to show interior details.
Figure 3:
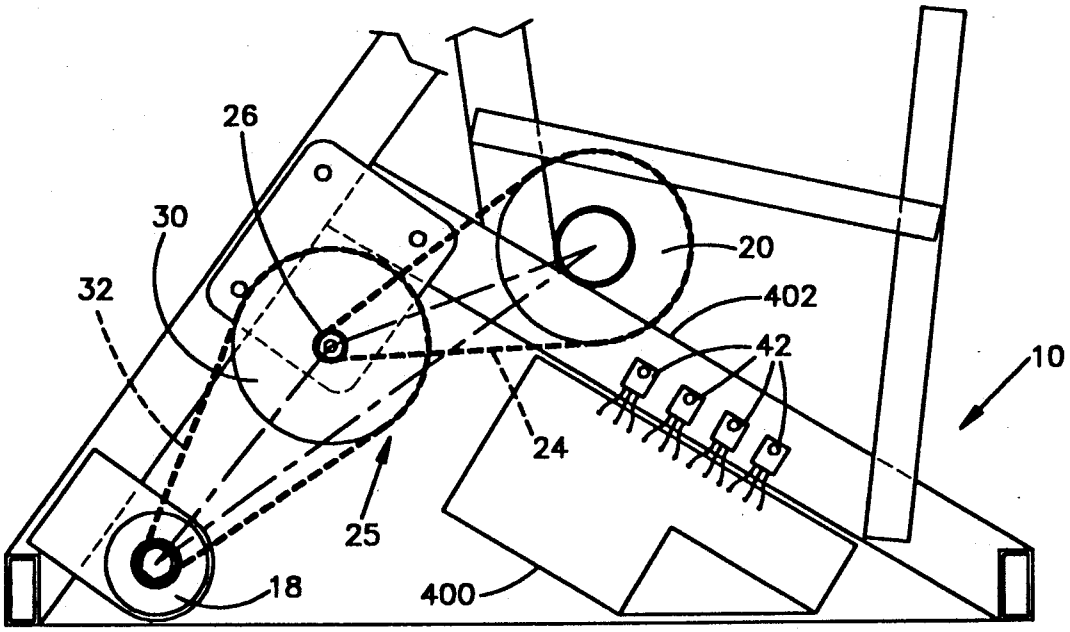
FIG. 3 is a fragmentary, plan view of the exercise bicycle shown in FIG. 2.

Turning also to FIGS. 2 and 3, the exercise bicycle includes a fixed base 10, an upwardly extending handle bar assembly 12, a seat assembly 14 and a pedal mechanism 16. As is known, a user or patient sits on the seat assembly 14, grasps the handle assembly 12 and then operates the pedal mechanism 16. A loading device 18, is operatively coupled to the pedal mechanism 16 and presents a resistance to pedaling that causes the user or patient to expend energy in operating the exercise bicycle.

In accordance with a more preferred embodiment of the invention, the load device 18 comprises a self excited, permanent magnet DC motor that is operated as a DC generator. As seen best in FIG. 2, a substantial gear ratio between the pedal mechanism 16 and DC motor/generator 18 is achieved by using a dual, cascaded chain arrangement including a sprocket 20 rotated by a pedal crank 22. A chain 24 transfers rotation of the pedal sprocket 20 to a compound idler sprocket 25 including a relatively small sprocket gear 26. The sprocket gear 26 is fixed to a shaft 28 which in turn is fixed to a much larger sprocket gear 30. A second chain 32 transfers rotation of the large sprocket 30 to the DC motor/generator 18 via sprocket 34.

As seen best in FIG. 3, a flywheel 36 is mounted to a motor shaft 18*a*. The disclosed chain/sprocket transmission provides a substantial gear ratio which may be in the order of 50:1., so that one rotation of the pedal sprocket 22 produces 50 rotations in the motor shaft 18*a*.

Figure 4:
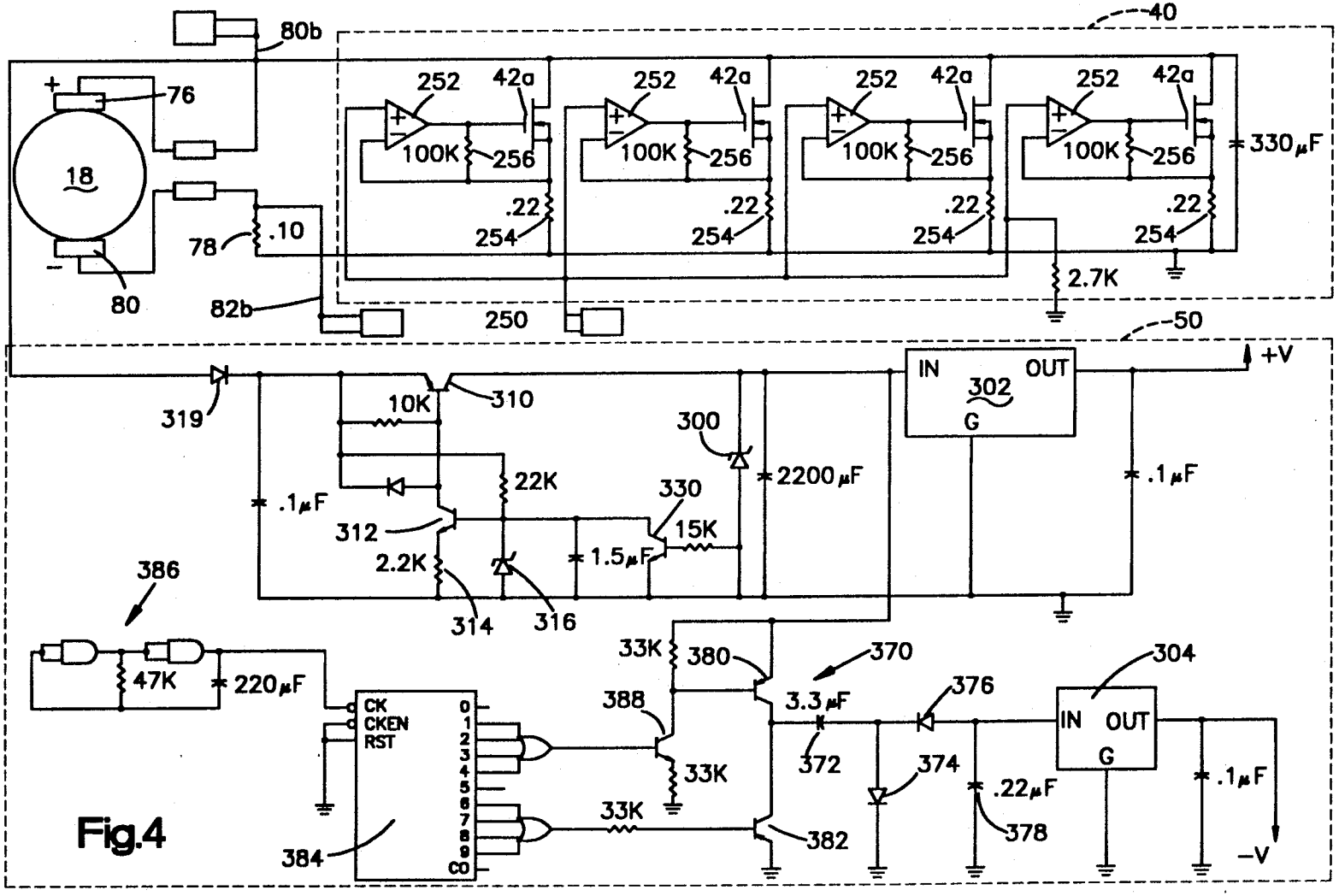
FIG. 4 is a schematic diagram of a power circuit forming part of the present invention; and, FIGS. 5A and 5B together comprise a schematic diagram of a control circuit for controlling the power circuit shown in FIG. 4.

Referring now to FIG. 4, the DC motor/generator 18 is electrically connected to a power circuit having a variable electrical load 40 which may include one or more semiconductor devices 42, capable of dissipating power delivered to the circuit by the motor/generator 18.

Figure 5A:
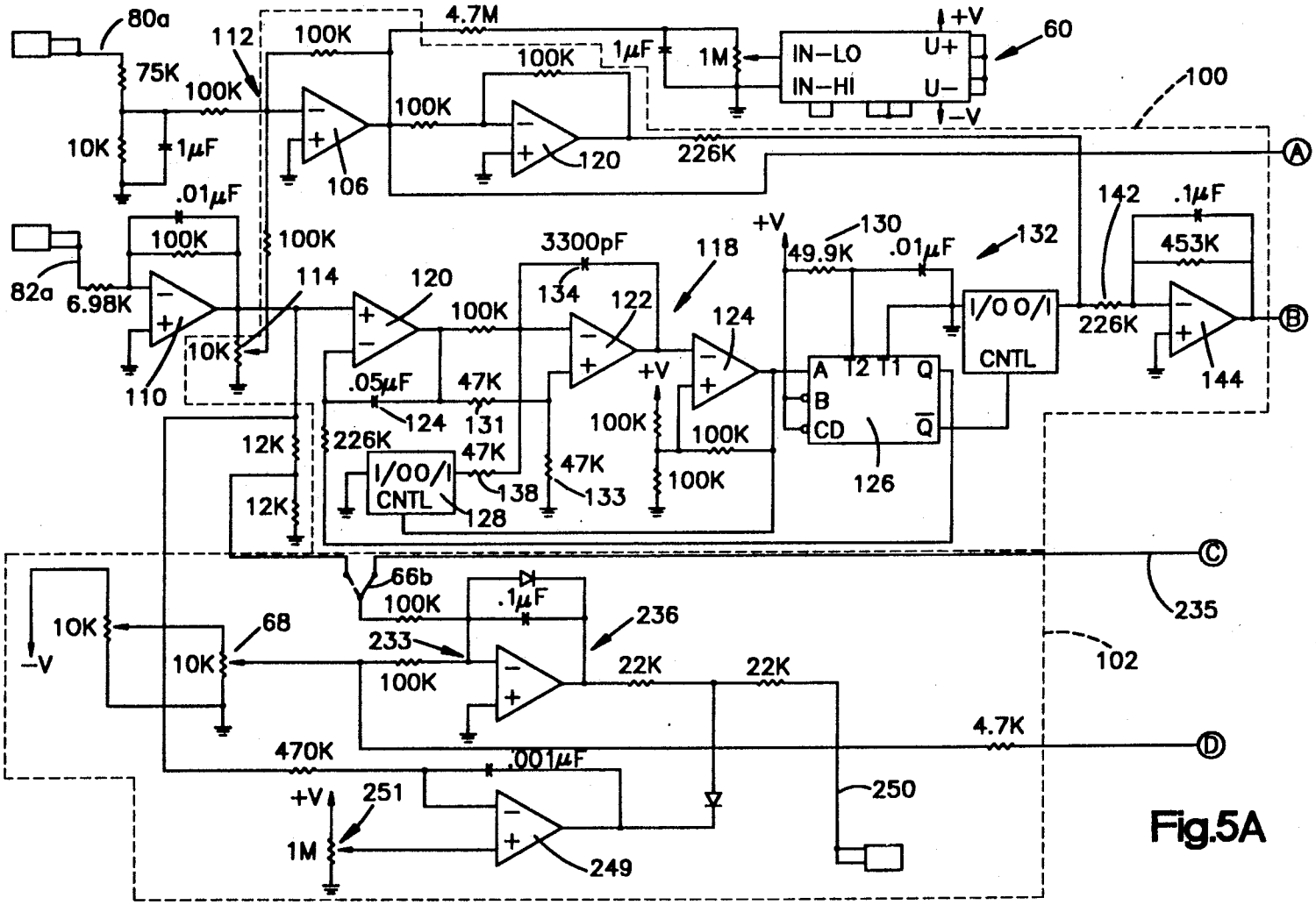
Figure 5B:
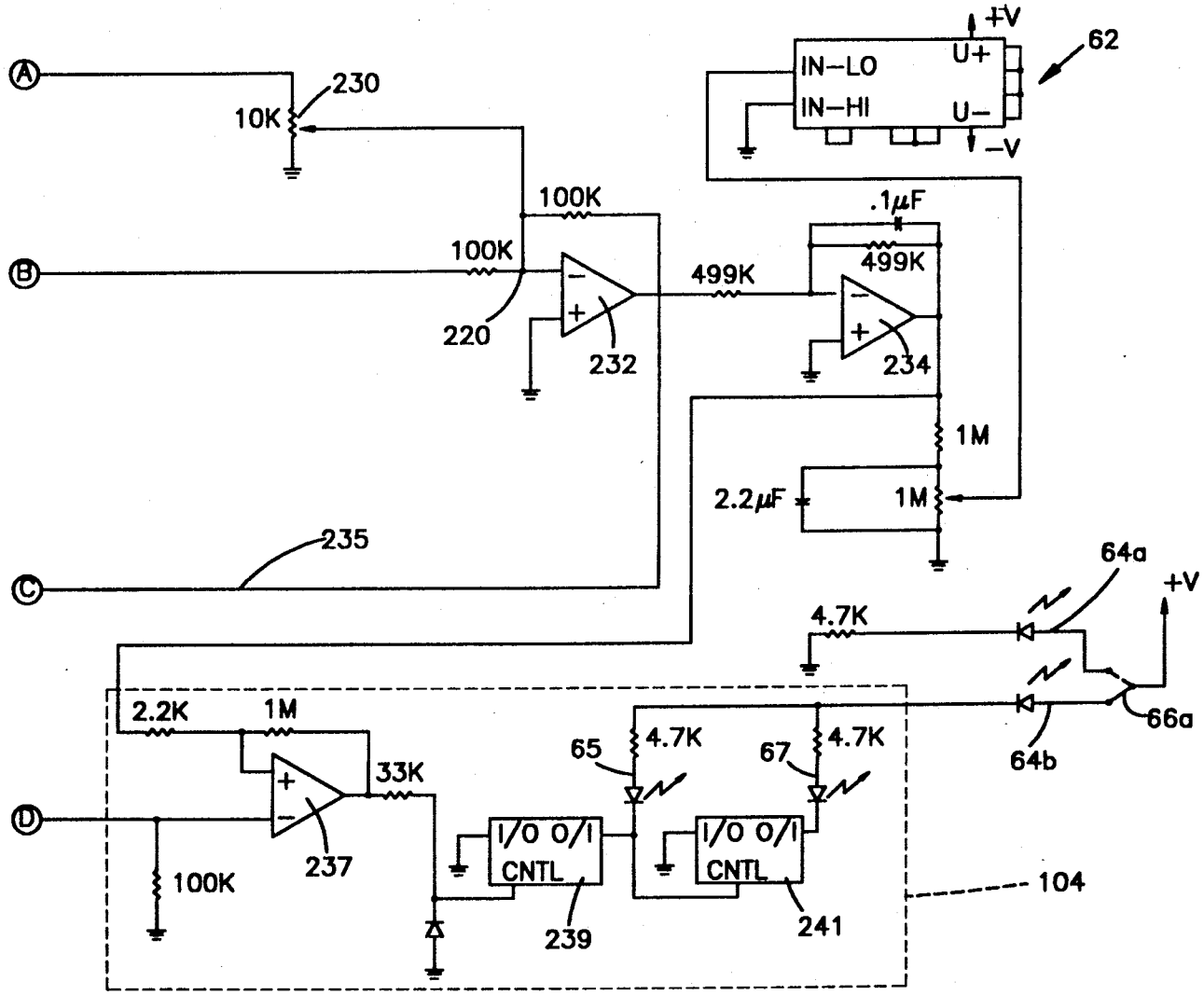

The power circuit also includes a DC power supply 50 which, in the illustrated embodiment, is electrically connected to the motor/generator 18 and utilizes some of the output of the generator to provide a regulated DC power supply, i.e. $+-12$ volts, to the control circuit shown in FIGS. 5A, 5B. In particular, the circuit 50 is operative to convert the voltage generated by the DC motor 18 which can vary between 13 and 80 volts to a regulated $+-12$ volts.

Turning now to FIGS. 5A, 5B, the disclosed control circuit can operate in a "constant power" or "constant force" mode. In the constant power mode, the overall power output of the exercise bicycle is maintained constant independent of pedaling speed. In this mode, the mechanical resistance to pedaling felt by the user or patient decreases as the pedaling speed increases in order to maintain constant power since the power output of a DC generator, in general, increases as shaft speed increases if the electrical load resistance across which the output voltage is applied, remains fixed.

In the constant force mode of operation, the force that must be applied to the pedals, by the user in order to effect rotation, remains constant independent of pedaling speed. Since the work output is a function of the force applied to the pedal and the pedaling speed, in this mode of operation, the work output of the user is proportional to the pedaling speed.

In the disclosed embodiment, the control circuit shown in FIGS. 5A, 5B, drives a speed display 60 (FIG. 5A) and a load display 62 (FIG. 5B). In addition, the control circuit includes lighted indicators, 64*a*, 64*b* for indicating to the user which mode of operation (either constant force or constant power) the unit is being operated in. The circuit also includes an indicating light 65 to signal the user that he or she is pedaling below a minimum speed needed to provide an output in the motor/generator 18 sufficient to power the electronics. A selector switch (not shown) including switch arms 66*a* (FIG. 5B), and 66*b* (FIG. 5A) is operable by the operator to select between the two modes of operation. The selector switch (not shown), the speed and load displays 60, 62 and indicator lights 64*a*, 64*b*, 65 as well as a power level selector 68 (shown schematically in FIG. 5A) are all mounted to a control panel 70 mounted to the handle assembly 12 so that all can be easily manipulated and/or viewed by the user.

The control circuit shown in FIG. 5A, 5B, receives a signal proportional to motor/generator output voltage and output current through respective leads 80*a*, 82*a*. The leads 80*a*, 82*a* are connected to leads 80*b*, 82*b* shown in FIG. 4 which form part of the power circuit. The voltage related signal is taken directly from the motor/generator terminal, in this case the positive terminal 76. The current related signal is actually a voltage signal that is directly proportional to the current output of the motor/generator and is derived from a small current sensing resistor 78 that is connected between a negative terminal 80 of the motor/generator 18 and ground (or 0 volts). The control circuit uses the voltage and current related signals to determine the power output of the motor/generator 18 and hence the energy output of the user or patient as well as the speed at which the exercise bicycle is being operated.

The control circuitry includes a circuit 100 for calculating power output of the motor/generator 18 based on the voltage related and current related signals (conveyed by the leads 80*a*, 80*b*) and a circuit 102 for selecting a given power/force level to be maintained. The circuit 102 includes a means for detecting that the power output of the motor/generator 18 is less than or greater than a selected output. When a difference is detected between the actual motor/generator output and the desired output, the circuit 102 modifies a control signal that is fed to the power dissipating circuit 40 and thereby alters the conductivity of the power dissipating devices 42.

In addition, circuitry 104 is provided for utilizing a signal related to the output of the motor/generator 18 in order to control the indicators 64*b*, 65.

The voltage related signal in lead 80*a* is connected to an inverting input of a first operational amplifier 106. The current related signal in lead 82*a* is connected to the inverting input of an operational amplifier 110 that may be used to scale the current signal depending on the characteristics of the motor/generator 18.

In general, the voltage at the output terminals 76, 80 of the motor/generator 18 will be less than an ideal or theoretical voltage for a given motor shaft speed due to internal resistance in the motor and resulting voltage drop across the motor windings. In order to compensate for this error in the voltage signal, a portion of the current signal that is output from the current sense operational amplifier 110 is added to the voltage signal through a summing junction 112 at the input to the operational amplifier 106. This current related compensation signal is provided by a voltage divider 114 connected between the output of the operational amplifier 110 and ground and in the illustrated embodiment is adjustable. It should be noted, that for a given type of motor/generator 18, a fixed resistance may be used.

The compensated voltage signal is output from the operational amplifier 106 and is coupled to an invertor circuit 120 which inverts the signal. The output of the summing amplifier 106 is also coupled to the speed display 60. The display is calibrated in units of revolutions per minute and the higher the voltage signal output from the summing amplifier 106, the higher the rate of rotation.

In order to determine the power output of the power generator, the product of voltage and current must be determined. Although, off-the-shelf multipliers are available, in the illustrated embodiment, the circuitry denoted as 100 utilizes inexpensive, off-the-shelf, components to arrive at a signal that is related to the product of the generator output voltage and the output current.

The electrical power determining circuit 100, includes a voltage to frequency converter indicated generally by the reference character 118, which in the illustrated embodiment, converts a voltage signal proportional to the current output of the motor/generator 18 to a signal having a frequency proportional to the current level. The voltage to frequency converter comprises three serially connected operational amplifier 120, 122, 124, a monostable multi-vibrator 126 and an analog switch 128. These elements may be formed by conventional, off the shelf semi-conductors. The multi-vibrator 126, the operational amplifiers 120, 122, 124 and the analog switch 128 are all available from Motorola, Inc under part numbers MC14538B, LM124, MC14066B, respectively.

As seen in FIG. 5A, the multi-vibrator 126, is arranged to emit a constant area pulse in response to a positive input at A. The width of the pulse is determined by the resistor 130 and capacitor 132 as is conventional. The Q output (which as will be explained is a series of pulses during operation of the exercise bicycle) is connected to the inverting input of the operational amplifier 120. The voltage signal, proportional to the current output of the motor/generator 18 is communicated to the non-inverting output of the operational amplifier 120. Capacitor 124 connected across operational amplifier 120 provides an integrating function. It integrates the difference between the DC signal (which is proportional to the current output of the generator) at the non-inverting input and the pulse input delivered to the inverting input.

The use of the operational amplifier 120 improves the accuracy of the voltage to frequency conversion. It has been found that the relationship between the current related voltage signal that is output from the operational amplifier 110 and the frequency that would be produced by the voltage to frequency circuit if the amplifier 120 were eliminated is not sufficiently linear. This is due at least in part to the rather large range of current levels (and hence voltage signals) that can occur during operation of the exercise device. By using the amplifier 120 to compare the DC signal level from the operational amplifier 110 to the DC level of the constant area pulses produced by the multi-vibrator 126, linearity is substantially improved. It has been found in practice that the linearity between the current related voltage input and the resulting frequency signal output is in the order of 0.1%.

The integrated DC level signal at the output of operational amplifier 120 is delivered to the inverting input of the operational amplifier 122. The non-inverting input of operational amplifier 112 is connected to a reference voltage formed by a voltage divider comprising resistors 131, 133. The voltage communicated from operational amplifier 120 charges a capacitor 134 and hence changes the output level of the operational amplifier 122. When this level exceeds the reference voltage at the non-inverting input of the operational amplifier 124, the amplifier 124 will change state and deliver a positive voltage to pin A of the multi-vibrator 126 and a positive voltage to the control input of the analog switch 128. This positive pulse will close the switch 118 and communicate the capacitor 134 with ground through a resistor 138 thus discharging the capacitor. Discharge of the capacitor 134 will cause the operational amplifier 122 to change level thereby changing the state of operational amplifier 124 terminating the voltage signal to pin A of the multi-vibrator 126 and the control input to the switch 128. This will allow the capacitor 134 to begin charging again.

It should be apparent that the time it takes the capacitor 134 to charge in order to force a state change in the operational amplifiers 122 and 124 will depend on the voltage level at the output of the operational amplifier 120. The higher the voltage level (corresponding to a higher current output of generator) the shorter the time for charging the capacitor 134. With the disclosed circuit arrangement, the output of the operational amplifier 124 in effect is a series of pulses, the frequency of which is a function of the voltage level at the output of operational amplifier 110 and hence, the current output of the motor/generator 18.

As indicated above, the Q output of the multi-vibrator 126 is used to produce a signal at the output of operational amplifier 120 that is the integrated difference between the current level signal and the pulse emitted by the multi-vibrator 126. The NOT Q output of the multi-vibrator 126 is used to control another analog switch 140 which controls a signal level related to output voltage of the motor/generator 18. This signal level is communicated to the inverting input of an operational amplifier 144. When NOT Q is high in the multi-vibrator 126, this signal is connected to ground. When NOT Q is low, the voltage related signal is communicated to the inverting input of the operational amplifier 144 through a resistor 142. As described above, the frequency at which the multi-vibrator 126 is emitting pulses is directly proportional to the current output of the motor/generator 18. As a result, the signal applied to the inverting input of the operational amplifier 144 is a series of pulses, the amplitude of which is a function of the voltage output of the motor/generator and the frequency of the which is proportional to the current output of the motor/generator. By integrating this signal using the operational amplifier 144, a signal that is proportional to the electric power output of the motor/generator 18 is provided at the output of the operational amplifier 144.

The output from the operational amplifier 144 (which can also be termed a low pass filter) is a signal related to the electrical load provided by the motor/generator 18. The actual load applied to the user or patient by the bicycle, includes the electrical load exerted by the motor/generator 18 and the mechanical load presented by the mechanism itself due to friction, etc. In order to determine the total work output of the user, a signal related to mechanical load is added to the electrical load at a summing junction 220.

Since the mechanical load is generally proportional to the speed of the motor/generator 18, the mechanical load factor is derived from the voltage signal of the motor/generator 18. A calibrating resistor 230 which forms part of a voltage divider is used to provide a compensating signal proportional to motor speed. The mechanical load signal and electrical load signal are summed at the inverting input of an operational amplifier 232, the output of which is proportional to the total load exerted on the user. The output from this summing amplifier 232 (which is proportional to the total power output) is passed through another invertor circuit 234 from where it is applied to the power output display 62 in order to display the instantaneous power output of the user. The display may be calibrated in units of kilogram-meters per minute. The output of the summing amplifier 232 is also connected to the power control circuit 102. The power control circuit when in the constant power mode, compares the total power output of the exercise bicycle (including electrical and mechanical load), to a selected power level and generates a control signal for adjusting the conductivity of the power dissipation circuit 40 (FIG. 4) in order to maintain the total power output of the bicycle substantially constant.

In particular, this total power signal is conveyed via lead 235 to a summing junction of an integrating circuit 236, forming part of the power control circuit 102, through the switch arm **66*b*. A second input to the summing junction 233 provides an operator adjustable signal having a negative voltage corresponding to a target power level. In the illustrated embodiment, the power level selector comprises an adjustable potentiometer 68 which may be mounted on the operator control panel 70. Alternately, the power selector may include thumb wheel switches for selecting discrete resistances to provide different voltages corresponding to selected power levels, to the summing junction 233**.

If the sensed total power is less than the selected power, the output from the integrating amplifier 236 increases. Since the target level signal is negative, and the output from the load amplifier 232 is positive, the input to the integrator is 0 when both signals are equal indicating that the total power output of the bicycle is equal to the selected power level. If the sensed power is greater than the selected power, the output from the integrating amplifier 236 decreases. A control signal, related to the difference or error between the selected power and the actual power output, is communicated to the power dissipation circuit 40 through a control signal lead 250.

As indicated above, the power dissipation circuit 40 includes one or more semi-conductor devices 42 for dissipating the output of the motor/generator 18. In the preferred and illustrated embodiment, four power MOSFET transistors are used to provide the necessary system capacity. MOSFET transistors sold under part number IRFP243 from International Rectifier have been found to provide satisfactory results at a reasonable cost.

As is known, the degree of conduction of the semiconductor device 42, is determined by the voltage signal at its gate **42*a*. As indicated above, a control signal which is proportional to the difference between the measured power output of the bicycle and the desired power output is generated by the power control circuit 102. This signal, is communicated to the non-inverting input of a control operational amplifier 252 associated with each power MOSFET 42. To insure that the current through each of the power MOSFETs is balanced, a current sensing resistor 254 is serially connected between the drain of each MOSFET and ground. A voltage proportional to current flow out of the power MOSFET is communicated to the inverting input of the operational amplifier 252. The signal output of the operational amplifier 252 is a function of the control signal and the actual measured output of its associated MOSFET. The resistors 256 connected between the output of each operational amplifier 252 and its associated inverting input provide protection to inhibit a build-up of voltage at the gate in excess of its rated voltage. With the disclosed circuit arrangement, the degree of conduction of each of the MOSFETs 42 is controlled by a single control signal and the current draw through each is balanced by virtue of the current sensing resistors 254 and feedback voltage communicated to the inverting input of each associated operational amplifier 252**.

The circuit has been described above as it functions in a "constant power" mode. In the constant power mode, the power output of the motor/generator 18 (which is the product of voltage and current) is constantly monitored and as described above, adjustments to the conductivity of the power MOSFETs 42 are made so that the product of the output current and output voltage of the motor/generator 18 is maintained substantially constant. The exercise bicycle can also be operated in a "constant force" mode. In this mode of operation, the pedal effort that must be exerted by the user or patient in order to rotate the pedal mechanism 16 remains constant independent of operating speed. As should be apparent, by maintaining the operating force constant, the power output of the exercise device is a linear function of operating speed (in this case pedal r.p.m.).

To place the device in a "constant force" mode, a mode switch is actuated by the operator which may be located on the control panel 70. When the switch is placed in the "constant force" position, switch arms **66*a*, 66*b* are moved to the phantom contact positions, shown in FIGS. 5A and 5B. In the constant force mode, the current output of the motor/generator 18 is maintained constant since the current output of a generator is directly proportional to its output torque. This torque is felt by the user as a mechanical resistance in the pedal mechanism 16. With the switch 66*b* in its phantom position, a voltage signal directly proportional to the output of the operational amplifier 110 (which is connected to the current sense lead 82*a*) is communicated to the integrating amplifier 236. This force related signal is summed with a reference signal from the level selecting potentiometer 68**.

The same potentiometer 68 can be used in both the constant power and constant force mode of operations since in both cases the reference signal is a voltage. Indicia (not shown) associated with the adjustment potentiometer 68 can indicate which force level or power level is being selected depending on the mode of operation that has been selected by the user. As explained above, any error detected between the force level selected (by the potentiometer 68) and the actual output of the motor/generator 18 produces an error signal which is communicated via the lead 250 to the control amplifiers 252 in the power dissipation circuit 40. The amplifiers 256 operate to adjust the conductivity of the power MOSFETs 42 to maintain a constant current output from the motor/generator 18. For example, if the force necessary to operate the pedals is greater than the selected or desired force level, an error signal will be produced by the integrating amplifier 236 which via control amplifiers 252 will decrease the conductivity of the power MOSFETs 42 in order to reduce the current output of the motor/generator 18, hence reducing the braking force exerted by the generator on the pedal mechanism 16.

In the illustrated embodiment, the control circuit limits the current output and hence the maximum force that can be exerted by the motor/generator 18. This is achieved using an operational amplifier 249 having its non-inverting input coupled to an adjustable voltage divider 251. The inverting input of the amplifier 249 is connected to the output of the amplifier 110 which is a voltage signal proportional to the current output of the motor/generator 18. When the current output signal from the amplifier 110 exceeds a predetermined maximum level that is established by the setting of the voltage divider potentiometer 251, the amplifier 249 communicates the control signal lead 250 to ground, thus turning off the MOSFETs. The drop in current output will cause the amplifier to change state and reestablish the control signal. In effect the amplifier 249 will modulate the conductivity of the power MOSFETs to limit the current flow to a predetermined maximum.

The four indicators 64*a*, 64*b*, 65, 67, which may comprise LED's, are located on the control and display panel 70. The indicator 64*b* is lit when the constant power mode is selected by the user. When the bicycle is in the constant power mode, the indicator 65 is lit when the load power is less than the selected power level (selected by the user using the potentiomater 68); the indicator 67 is off. When the power output reaches the selected power level, the indicator 67 is lit and the indicator 65 is extinguished. An operational amplifier 237 compares the measured load (or total power signal) from the amplifier 234 to the selected load (selected by the potentiometer 68). The amplifier 237 changes states to activate and deactivate analog switches 239, 241 as the power level varies above and below the predetermined minimum level.

The DC power supply 50 converts a portion of the output of the generator which may vary between 13 and 80 volts to a $+-V$ supply (i.e. $+-12$ volts) needed to power the electronics of the circuits shown in FIGS. 4, 5A and 5B. To achieve this function, without the need for an inordinately expensive regulator, a zener diode 300 is used to maintain the magnitude of the input voltage to positive and negative voltage regulators 302, 304 at 30 volts or less. Voltage regulators operable with input voltage variations between 13 and 30 volts are readily available and inexpensive.

At motor/generator output voltages less than a predetermined voltage i.e. 30 volts, a transistor 310 is placed in a full conducting state and communicates motor/ generator output voltage to the voltage regulator 302. At output voltages less than the predetermined voltage, transistor 312 which is connected to the base of the transistor 310 acts as a current regulator in conjunction with a resistor 314 and zener diode 316. The current level drawn by the transistor 312 is determined by the value of the resistance 314 and the zener diode 316. If for example the diode 316 is rated at 5 volts and the resistor is as shown, the current through the transistor will be approximately 5 milliamps. Since the transistor 312 is connected directly to the base of the transistor 310, which is preferably a PNP type transistor, transistor 310 is turned on for motor voltages greater than five volts and less than the predetermined voltage.

Preferably the transistor 310 is selected to have a collector to emitter voltage drop of no more than 0.1 volts when it is in saturation. Consequently, motor/generator voltage less the voltage drop across the transistor 310 (approximately 0.1 volts) and the drop across an input protection diode 319 (approximately 0.6 volts) is communicated to the regulator 302. It has been found, that with a motor/generator output of 14.2 volts, a voltage regulator is available that will produce a $+12$ volt output. With the motor/generator 18 and disclosed mechanical coupling (50:1 ratio) between the pedal mechanism 16 and the DC motor/generator 18, it has been found that sufficient voltage to power up the electronics is achieved at 30 RPM (pedal speed).

When the voltage exceeds the predetermined value, i.e., greater than 30 volts, the zener diode 300 is selected to conduct at the predetermined voltage and turns on a transistor 330. The transistor 330 is connected across the base of the transistor 312 and since it is placed in a conducting state at voltages above the predetermined voltage, the transistor 312 is turned off (since the 5 volt bias provided by the diode 316 is terminated) which in turn, turns off the transistor 310. In actual operation, since the voltage to the zener diode 300 is fed from the transistor 310, the diode 300 will revert to its non-conducting state, thereby turning off transistor 330, turning on transistor 3312, which in turn will turn on the transistor 310. In effect, at voltages above the predetermined voltage, the transistor 310 will modulate the voltage applied to the regulator 302 to a value less than the predetermined value determined by the zener diode 300.

The $-12$ volt supply is provided by a charge pump indicated generally by the reference character 370. The voltage applied via the transistor 310, to the positive voltage regulator 302 is also communicated to a charge pump 370 consisting of capacitor 372, diode 374, diode 376 and a capacitor 378. Transistors 380, 382 are arranged such that any given instant, one transistor is conducting when the other is not. The states of the transistors 380, 382 control the charging of the capacitor 372 through the diode 374 which is connected to ground. When the transistor 380 is turned on (and the transistor 382 is off) the capacitor 372 is connected to the modulated motor/generator voltage that is applied to the positive regulator 302. In this state the capacitor 372 is positively charged. When the transistor 380 turns off and the transistor 382 is turned on, the positive side of the capacitor (which is now charged to the voltage being applied to the positive regulator 302) connects the positive side of the capacitor to ground. The opposite side of the capacitor 372 is negative and is forced below ground. The diode 374 stops conducting and the diode 376 begins conducting causing a negative voltage to be applied to the negative regulator 304. This negative voltage also charges a filtering capacitor 378. The negative voltage regulator is designed and/or selected to produce a −12 volts output for an input that is slightly less than −12 volts, i.e. −13 volts.

The switching of the transistor 380, 382 is controlled by a decade counter 384. A conventional clock circuit 386 is connected to the decade counter 384 which is arranged as a ring counter. To insure that the transistors 380, 382 are never turned on concurrently, the decade counter 384 arranged so that for at least one output state, neither transistor is active. In particular, and as seen in FIG. 4, when any one of four outputs (labelled 1–4) are active, the transistor 380 is placed in a conducting state via transistor 388. When another four outputs (labelled 6–9) are in an active state, the transistor 382 is placed in a conducting state leaving two outputs (labelled 0 and 5) not connected to either transistor. In the illustrated embodiment, when any of the outputs 1–4 of the decade counter 384 are high, the transistor 380 is turned on. When any of the outputs 6–9 are high the transistor 382 is on. When the outputs 0 or 5 are high, both transistors are off.

The electronic circuit shown in FIGS. 4, 5A and 5B is mounted in the base 10 of the exercise device underneath an external cover. In particular, and referring to FIG. 3, a circuit board is attached to a mounting plate 400 which is attached to a frame member 402 forming part of the exercise bicycle. The power MOSFETs 42 are directly fastened to the frame 402. Preferably, the frame member 402 is constructed of a material such as aluminum having good heat transfer characteristics. The heat generated by the power MOSFETs 42 during operation is transferred to the frame member 402 which acts as a heat sink and dissipates the heat.

As stated above, in the preferred embodiment, a flywheel 36 is mounted to the motor/generator drive shaft 18*a*. The flywheel 36 is used to store kinetic energy so that the force necessary to operate the pedal mechanism 16 is averaged over the 360° rotation. It must be remembered, that with a pedal mechanism the force needed to produce movement varies with the position of the pedals. When the pedals are in a vertical position, the force needed to produce movement is in theory infinite since the vector of the force applied by the operator is coincident with the moment arm. When the pedals are in the horizontal position, the force needed to rotate the mechanism is usually at a minimum level since the force vector is located 90° with respect to the moment arm. The flywheel 36 stores kinetic energy to help carry the pedals through the positions at which excessive force would be needed to produce movement in the pedal mechanism 16 i.e., vertical position.

It has been found that with a pedal mechanism 16 having a crank lever arm of 6" and a 50:1 gear ratio between the peddle sprocket 20 and the motor shaft 18*a*, a flywheel comprising a steel disk 5" in diameter and ¼" thick, weighing 3 pounds, can store sufficient kinetic energy so that at 40 r.p.m. with a 200 watt load, the pedals coast through the vertical positions without creating an uncomfortable dragging action for the feet. This creates a smooth cycle action for the user and requires a foot force of approximately 70 pounds to pedal the bicycle which is considered to be a comfortable foot force for an adult. It should be noted that the weight of the flywheel can be reduced by increasing its diameter while decreasing its thickness because the moment of inertia varies as the square of the radius of the flywheel.

As indicated above, in the preferred embodiment, the loading device comprises a permanent magnet, DC motor used as a generator. A DC motor provides several advantages over a generator. Firstly, permanent magnet DC motors are readily available and are relatively inexpensive as compared to other types of loading devices such as eddy current brakes and field wound DC generators. Moreover, the DC motor can be powered externally in order to calibrate the exercise device. For example, the mechanical load exerted by the mechanics of the exercise device can be measured by powering the DC motor externally and measuring the voltage and current needed in order to produce a given r.p.m. in the pedal mechanism. In addition, the DC motor can be actuated to drive the pedal mechanism so the user can operate the exercise device in a "no load" mode. In this mode of operation, the user would not expend energy to operate the mechanism. Instead the DC motor would drive the pedal mechanism 16 in order to "exercise" or "limber up" the legs of a patient.

Although the invention has been described with a certain degree of particularity it should be understood that those skilled in the art can make various changes to it without departing from the spirit or scope of the invention as hereinafter claimed.

I claim:

1. An exercise device, comprising:

a) a user operated device actuating mechanism;

b) a DC generator means coupled to said actuating mechanism by a coupling means such that actuation of said actuating mechanism produces rotation in a drive shaft of said DC generating means;

c) power dissipation means electrically coupled to said DC generating means operative to dissipate the output of said DC generator means in order to control a braking effect exerted by said DC generator means on said actuating mechanism; and, d) compensation means forming part of a control means for compensating for electrical related losses in said DC generating means, said compensating means including a compensating signal derived directly from the current output of the DC generating means, said compensating signal being used by said control means to at least partially compensate for a reduced output voltage in said DC generator means due to internal electrical resistance in said DC generator means.

2. The apparatus of claim 1 wherein said DC generator means comprises a permanent magnet, DC motor operated as a DC generator.

3. The apparatus of claim 1 wherein said dissipation means includes at least one power MOSFET connected across output terminals of said generator means and further including a control amplifier associated with said power MOSFET for altering the conductivity of said power MOSFET in accordance with changes in a control signal produced by said control means.

4. The apparatus of claim 3 wherein said dissipation means includes a plurality of said power MOSFETs and further including a current sensing resistor connected in series with each of said MOSFETs for monitoring current flow therethrough, and feedback means connected to each of said current sensing resistors operative to adjust the conductivity of each of said power MOSFETs so that power dissipation through each of said MOSFETs is substantially equal and distributed equally among each of said MOSFETs.

5. The apparatus of claim 4 further including current sensing means associated with each MOSFET for monitoring current flow therethrough and further including feedback means for adjusting the conductivity of said MOSFETs in response to said current sensing means in order to distribute power, substantially equally among the plurality of MOSFETs.

6. The apparatus of claim 4 wherein a frame member of said exercise device forms a heat sink for dissipating heat generated in said power MOSFETs.

7. The apparatus of claim 1 wherein said user actuated mechanism comprises a foot operated pedal mechanism.

8. The apparatus of claim 1 further comprising a level selection means operable by said user to adjust a power output level that will be maintained by said exercise device independent of operating speed.

9. The apparatus of claim 1 further comprising a force level selection means operable by said user to input a desired force level to be maintained by said control means independent of operating speed.

10. The apparatus of claim 1 further comprising multiplying means for determining the product of the current and voltage output of the DC generating means.

11. The apparatus of claim 1 further comprising current limiting means operative to limit the maximum output current of said generating means.

12. The apparatus of claim 1 further including indicator means operative to indicate that the output of the generator means is below a predetermined minimum.

13. A control means for controlling the electrical output of a DC generator means forming part of an exercise device, comprising:

a) user actuatable mechanism for imparting rotation to said DC generator means;

b) power dissipation means for dissipating power generated by said DC generator means upon actuation by said actuating mechanism;

c) reference signal input means for inputing a reference signal to said control means; and d) comparing means forming part of said control means for comparing power output of said exercise device including means for adjusting said power dissipation means if an error exists between said reference signal and a signal derived from the voltage and current output of said generator means; and, f) heat sink means forming part of said exercise device operative to dissipate heat generated by said power dissipation means.

14. The apparatus of claim 13 wherein said reference signal is related to a desired force level to be maintained by said generator means independent of actuation speed.

15. The apparatus of claim 13 wherein said reference signal is related to a desired power level to be maintained by said generator means independent of actuation speed.

16. The apparatus of claim 13 wherein said power dissipation means includes at least one power MOSFET and said means for adjusting, adjusts the conductivity of said power MOSFET.

17. An exercise system, comprising:

a) an exercise device including:

i) a user operated device actuating mechanism;

ii) a DC generator means coupled to the actuating mechanism such that actuation of the mechanism by the user produces rotation in a drive shaft of said DC generating means;

b) electronic control means for controlling a braking effect exerted by said DC generator means on said actuating mechanism;

c) DC power supply means for electrically powering said electronic control means, comprising:

i) means connecting an output of said DC generator means to a first stage voltage regulation means;

ii) said first stage regulation means operative to limit voltage applied to a second stage voltage regulation means to a predetermined maximum voltage;

iii) said second stage voltage regulation means including separate positive and negative voltage regulators operative to provide relatively low positive and negative power supply voltages for said electronic control means.

18. The system of claim 17 wherein said first stage voltage regulation means includes a PNP-type semiconductor in series with said second stage voltage regulation means, said PNP semi-conductor device having a voltage drop of approximately 0.1 volt when in a conducting state.

19. The system of claim 17 wherein said second stage voltage regulation means includes a charge pump for generating a negative voltage to be applied to said negative voltage regulator.

20. The system of claim 19 wherein said charge pump includes switch means for charging and discharging a compacitor, said switch means being controlled by a ring counter.

21. The system of claim 20 wherein said ring counter is formed by a decade counter and clock circuit and said switch means comprises a pair of transistors, the state of one of said transistors being determined by 4 of 10 outputs of said decade counter and the state of said other transistor being controlled by another 4 of said 10 outputs of said decade counter.

22. The system of claim 17 wherein said electronic control means comprises:

a) a power dissipation means including a plurality of power MOSFETs operative to dissipate power generated by said DC generating means;

b) power dissipation control means operative to control conductivity of said power MOSFETs including balancing means for distributing current flow, substantially equally, through each of said plurality of MOSFETs.

23. The system of claim 22 further comprising:

a) comparing means for comparing an input reference signal, selected by a user of said device, with a power output signal produced by a power determining circuit; and, b) gate voltage adjustment means for adjusting the gate voltage of each of said power MOSFETs in response to errors detected by said comparing means.

24. The system of claim 23 wherein said electronic control means further includes mechanical loss compensation means and an internal loss compensation means operative to generate a power output signal for said exercise device that includes a power output factor related to mechanical losses in said exercise device and a power output factor related to internal electrical losses in said DC generating means.

25. The system of claim 17, wherein said DC generating means comprises a self-excited, permanent magnet DC motor operated as a generator.

26. The system of claim 23 wherein said power determining circuit includes a multiplying means comprising:

a) a voltage to frequency converter operative to convert a current related voltage signal to a signal comprising a series of pulses in which the frequency of said signal pulses is proportional to an output current of said generator means;

b) amplitude adjusting means for adjusting the amplitude of said signal pulses such that the amplitude of said signal pulses is proportional to the output voltage of said DC generator means; and, c) integrating means for integrating said frequency and an amplitude varying signal to produce an integrated signal that is proportional to the electrical power output of said generating means.

27. A method of controlling a loading device in an exercise system, comprising the steps of:

a) coupling a DC generator means to a user actuatable mechanism such that actuation of said mechanism produces rotation in said DC generator means;

b) controlling a braking effect exerted by said DC generator means on said actuating mechanism by:

i) substantially continuously comparing a power output signal derived from the voltage and current output of said generator means with a reference signal; and, ii) adjusting the conductivity of at least one power MOSFET forming part of a power dissipation means in response to sensed differences between said reference signal and said power output signal.

28. The method of claim 27 wherein said power output signal is determined by:

a) converting a signal related to current output of said DC generator means to a frequency signal whose frequency is proportional to the current output of said DC generator means;

b) modulating the amplitude of pulses forming part of said frequency signal such that the amplitude of said pulses is proportional to the voltage output of said DC generator means;

c) integrating said frequency signal to produce a signal that is proportional to the electrical power output of said DC generator means.

29. An exercise device comprising:

a) a user operated device actuating mechanism;

b) a DC generator means mechanically coupled to said actuating mechanism by a coupling means such that actuation of said actuating mechanism produces rotation in a drive shaft of said DC generating means;

c) power dissipation means operative to dissipate the electrical output of said DC generator means in order to control a braking effect exerted by said DC generator means on said actuating mechanism; and, d) multiplying means including:

i) a voltage to frequency converter operative to convert a voltage signal related to the current output of said DC generator means to a signal comprising a series of pulses in which the frequency of said signal pulses is proportional to an output current of said generator means;

ii) amplitude adjusting means for adjusting the amplitude of said signal pulses such that the amplitude of said signal pulses is proportional to the output voltage of said DC generator means; and iii) integrating means for integrating said frequency and an amplitude varying signal to produce an integrated signal that is proportional to the electrical power output of said generating means.

30. The apparatus of claim 29 further including a mechanical power compensating means responsive to the voltage and current output of said DC generating means and including means for generating a signal proportional to the speed of said DC generator means that is derived using the voltage and current output of said generating means such that said signal is related to the mechanical load of said exercise device at a given operating speed and further including summing means for adding said compensating signal to said integrated signal to produce a total power signal that is related to the total power output of said exercise device.

31. A method of controlling a loading device in an exercise system, comprising the steps of:

a) coupling a DC generator means to a user actuatable mechanism such that actuation of said mechanism produces rotation in said DC generator means;

b) determining the power output of the exercise system by:

c) producing a first power signal proportional to the product of the output current and voltage of the generator means using a multiplying means;

d) deriving a total power signal by summing said first power signal with a compensation signal that is proportional to internal electrical losses in said generator means;

e) controlling a braking effect exerted by said DC generator means on said actuating mechanism by:

i) substantially continuously comparing said total power signal with a reference signal; and, ii) adjusting the dissipation rate of a power dissipation means in response to sensed differences between said reference signal and said total power signal.

32. A method of controlling a loading device in an exercise system, comprising the steps of:

a) coupling a DC generator means to a user actuatable mechanism such that actuation of said mechanism produces rotation in said DC generator means;

b) determining the power output of the exercise system by:

c) producing a first power signal proportional to the product of the output current and voltage of the generator means using a multiplying means;

d) deriving a total power signal by summing said first power signal with a compensation signal that is proportional to internal electrical losses in said generator means and the mechanical loads imposed by said user actuated mechanism;

e) controlling a braking effect exerted by said DC generator means on said actuating mechanism by:

i) substantially continuously comparing said total power signal with a reference signal; and, ii) adjusting the dissipation rate of a power dissipation means in response to sensed differences between said reference signal and said total power signal.

33. The method of claim 32 wherein adjusting said dissipation rate comprises the step of adjusting the conductivity of a semi-conductor device forming part of said dissipation means across which the output of said generator means is applied.

* * * * *